US008496546B2

(12) United States Patent
Bulloch

(10) Patent No.: US 8,496,546 B2
(45) Date of Patent: Jul. 30, 2013

(54) REBOUNDING APPARATUS

(76) Inventor: Ronald C. Bulloch, Fort Wayne, IN (US)

( * ) Notice: Subject to any disclaimer, the term of this patent is extended or adjusted under 35 U.S.C. 154(b) by 272 days.

(21) Appl. No.: 12/806,940

(22) Filed: Aug. 24, 2010

(65) Prior Publication Data

US 2011/0053713 A1 Mar. 3, 2011

Related U.S. Application Data

(60) Provisional application No. 61/275,094, filed on Aug. 25, 2009.

(51) Int. Cl.
*A63B 69/34* (2006.01)

(52) U.S. Cl.
USPC ..... 473/435; 273/395

(58) Field of Classification Search
USPC ..... 473/190, 415, 435, 436, 451; 273/395, 273/396; 108/35, 125
See application file for complete search history.

(56) References Cited

U.S. PATENT DOCUMENTS

| | | | | | |
|---|---|---|---|---|---|
| 2,190,498 | A | * | 2/1940 | Williams | 312/243 |
| 2,870,832 | A | * | 1/1959 | Linquist et al. | 160/351 |
| 2,944,816 | A | | 7/1960 | Dixon | |
| 2,992,002 | A | | 7/1961 | Bingham, Jr. | |
| 3,013,801 | A | | 12/1961 | Kirkconnell, Jr. | |
| 3,511,503 | A | | 5/1970 | Volpe | |
| 3,836,144 | A | | 9/1974 | Mahoney | |
| 3,915,102 | A | * | 10/1975 | Barron | 108/146 |
| 4,119,311 | A | | 10/1978 | Jenkins et al. | |
| 4,421,318 | A | | 12/1983 | Sverdlik et al. | |
| 4,478,420 | A | | 10/1984 | Sowards | |
| 4,489,941 | A | | 12/1984 | Shieh | |
| 4,553,751 | A | | 11/1985 | Ketchum | |
| 4,693,472 | A | | 9/1987 | Newman et al. | |
| 5,007,638 | A | | 4/1991 | Yukl | |
| 5,048,844 | A | | 9/1991 | Haseltine | |
| 5,118,103 | A | | 6/1992 | Miller | |
| 5,299,989 | A | | 4/1994 | Boyd et al. | |
| 5,549,304 | A | | 8/1996 | Davis | |
| 5,556,104 | A | | 9/1996 | Guillen, Jr. | |
| 5,807,193 | A | | 9/1998 | Talarico et al. | |
| 5,833,234 | A | | 11/1998 | Vavala et al. | |
| 5,839,980 | A | * | 11/1998 | Kendy | 473/478 |
| 5,857,679 | A | | 1/1999 | Ringe et al. | |
| 5,934,679 | A | * | 8/1999 | Strain et al. | 273/395 |
| 5,954,600 | A | * | 9/1999 | Gill | 473/478 |
| 5,967,943 | A | | 10/1999 | Rich | |
| 6,036,620 | A | * | 3/2000 | Yang | 482/27 |
| 6,209,877 | B1 | * | 4/2001 | Warnick | 273/396 |
| 6,250,634 | B1 | | 6/2001 | Strain et al. | |
| 6,287,220 | B1 | | 9/2001 | Caruso | |

(Continued)

OTHER PUBLICATIONS

Webpage download, PatrickMetal, 2008, web.archive.org/web/20080608094601/http://www.patrickmetals.com/scripts/square_flange.php?item=9, 1 page.*

*Primary Examiner* — Gene Kim
*Assistant Examiner* — M Chambers
(74) *Attorney, Agent, or Firm* — Bose McKinney & Evans LLP

(57) ABSTRACT

A rebounding apparatus for returning soccer balls, baseballs and similar projectiles. The apparatus includes a rigid frame with a rebounding surface suspended within the frame. Pivotal support assemblies are used to support the apparatus in both horizontal and vertical orientations. The apparatus can be folded into a compact configuration for transport or storage.

16 Claims, 6 Drawing Sheets

U.S. PATENT DOCUMENTS 6,536,358 B1 * 3/2003 Fears ..... 108/116
6,659,914 B2 12/2003 Plante
6,739,988 B2 5/2004 Jensen et al.
6,846,253 B1 1/2005 Szwalek
6,893,364 B1 5/2005 Grunfeld
6,935,971 B2 * 8/2005 Piras et al. ..... 473/435
7,264,245 B2 9/2007 Cho
7,462,114 B2 12/2008 Moller, Jr.
2008/0261727 A1 * 10/2008 Snyder ..... 473/435

* cited by examiner

REBOUNDING APPARATUS

CROSS REFERENCE TO RELATED APPLICATIONS

This application claims priority under 35 U.S.C. 119(e) of U.S. provisional patent application Ser. No. 61/275,094 filed on Aug. 25, 2009 entitled REBOUNDING APPARATUS the disclosure of which is hereby incorporated herein by reference.

BACKGROUND OF THE INVENTION

1. Field of the Invention

The present invention relates to athletic training equipment and, more specifically, to a device that can be used for rebounding activities such as rebounding a soccer ball.

2. Description of the Related Art

The use of rebounding devices to return a soccer ball, baseball or other object to a user after that person has kicked, thrown or otherwise projected the ball at the rebounder is known in the art. Many of the rebounders currently found in the marketplace, however, are not built to withstand heavy or prolonged usage.

SUMMARY OF THE INVENTION

The present invention provides a rebounder having a rugged and robust design that can be manufactured in a cost-efficient manner.

The invention comprises, in one form thereof, a springless rebounding apparatus for rebounding a projectile. The rebounding apparatus includes a plurality of elongate frame members secured together to form a structural frame defining a central opening. Each of the frame members have a cross section that includes a first section and a flange projecting outwardly from the first section and defining a distal edge. The frame members are secured together such that the flanges project axially from the first sections and a first axial length of the central opening is circumscribed by the flanges and axially disposed between the distal edges of the flanges and the first sections. The first axial length of the central opening forms a larger opening than a second axial length of the central opening that is circumscribed by the first sections of the frame members. A springless bounceback assembly is supported by the structural frame within the first axial length of the central opening and is adapted to rebound the projectile. The bounceback assembly includes a flexible sheet of material defining a rebounding surface and having an outer edge. A plurality of elastic loops are secured to the flexible sheet proximate the outer edge. A plurality of elongate mounting members are each inserted through at least one of the elastic loops and are secured to one of the frame members.

The invention comprises, in another form thereof, a rebounding apparatus for rebounding a projectile. The rebounding apparatus includes a plurality of elongate frame members secured together to form a structural frame defining a central opening. A bounceback assembly is supported by said structural frame within said central opening and adapted to rebound the projectile. The bounceback assembly includes a flexible sheet of material defining a rebounding surface and having an outer edge. A plurality of tensioning members are operably disposed between the flexible sheet and the structural frame. The apparatus also includes a pair of leg assemblies. Each of the leg assemblies includes a pair of elongate legs defining a hollow cross section. Each of the leg assemblies are pivotally secured to the structural frame wherein the leg assemblies are pivotal between a collapsed configuration, a horizontal deployment configuration and a vertical deployment configuration. In the collapsed configuration, both of the leg assemblies are positioned proximate the structural frame. In the horizontal deployment configuration both of the leg assemblies project outwardly from the structural frame. In the vertical deployment configuration one of the leg assemblies is positioned in a non-weight bearing position and the other of the leg assemblies projects outwardly from the structural frame toward the ground surface. A pair of first foot assemblies is provided wherein each of the first foot assemblies includes a first shaft insertable into a selected one of the legs and including a first foot member extending at an angle from the first shaft. The first foot members each include a lawn spike adapted for use with a piercable ground surface. A pair of second foot assemblies is also provided wherein each of the second foot assemblies includes a second shaft insertable into a selected one of the legs and includes a second foot member extending at an angle from the second shaft. The second foot members each include a ground engaging member adapted for use with a hard ground surface. A pair of third foot assemblies is also provided and each of the third foot assemblies includes an elongate extension shaft insertable into a selected one of the legs. The third extension shafts are longer than the first and second shafts. When the leg assemblies are in the collapsed configuration, the pair of first foot assemblies and the pair of second foot assemblies are storably insertable in the legs of the first and second leg assemblies and the pair of third foot assemblies is securable to an exterior surface of the first and second leg assemblies. Securement of the pair of third foot assemblies to the first and second leg assemblies secures the first and second leg assemblies in the collapsed configuration.

The invention comprises, in yet another form thereof, a rebounding apparatus for rebounding a projectile. The rebounding apparatus includes a plurality of elongate frame members secured together to form a structural frame defining a central opening. A springless bounceback assembly is supported by the structural frame within the central opening and is adapted to rebound the projectile. The bounceback assembly includes a flexible sheet of material defining a rebounding surface and having an outer edge. A plurality of elastic loops are secured to the flexible sheet proximate the outer edge. A first plurality of elongate mounting members and a second elongate mounting member are provided. Each of the first plurality and second mounting members are inserted through at least one of the elastic loops and is secured to one of the frame members. A first portion of the outer edge of the flexible sheet extending adjacent each of the first plurality of elongate mounting members is positioned in a common plane and a second portion of the outer edge of the flexible sheet extending adjacent the second elongate mounting member is axially displaced relative to the common plane.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figures 1, 2, 3, 4, 5, 6:
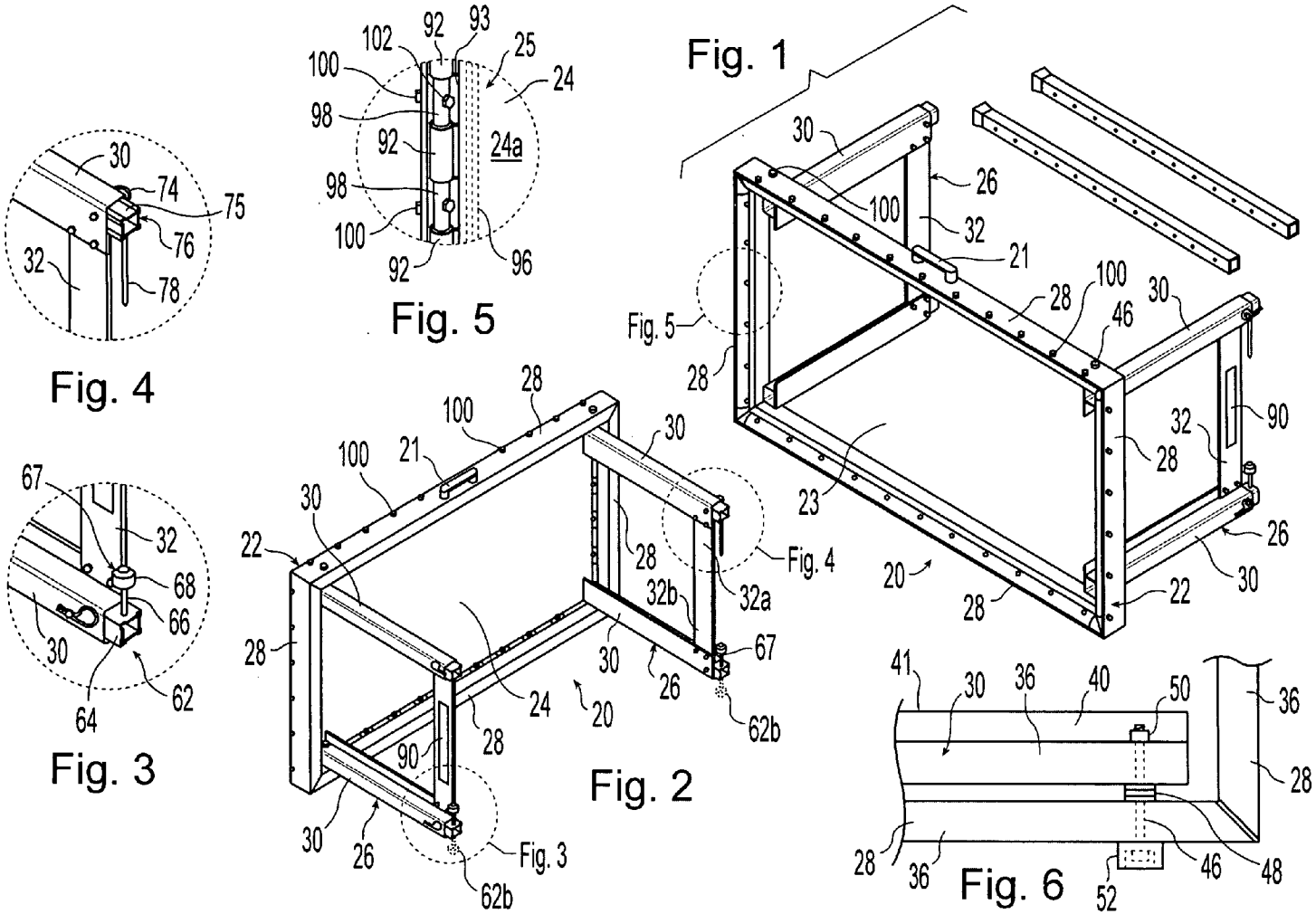
FIG. 1 is a front partial perspective view of a rebounding (the rebounding surface is not shown).
FIG. 2 is a rear perspective view of the rebounder.
FIG. 3 is a detail view of a portion of FIG. 2.
FIG. 4 is a detail view of a portion of FIG. 2.
FIG. 5 is a detail view of a portion of FIG. 1 (showing the rebounding surface).
FIG. 6 is a rear view of a corner of the rebounder.

Corresponding reference characters indicate corresponding parts throughout the several views. Although the exemplification set out herein illustrates embodiments of the invention, in multiple forms, the embodiments disclosed below are not intended to be exhaustive or to be construed as limiting the scope of the invention to the precise forms disclosed.

DETAILED DESCRIPTION OF THE INVENTION

A rebounder 20 in accordance with the present invention is shown in FIGS. 1 and 2. Rebounder 20 includes a structural frame 22 with a central opening 23 defining an axis 20*a*, a bounceback assembly 25 having a rebounding member formed by a flexible sheet of material 24, and leg assemblies 26. It is noted that rebounding member 24 and tensioning members 92 have been omitted from FIG. 1 for purposes of graphical clarity.

In the illustrated embodiment, frame 22 is formed by welding four frame members 28 together to form a four-sided rectilinear frame 22. The illustrated frame 22 has a length of approximately 42 inches and a width of approximately 24 inches and is well suited for use in rebounding soccer balls. Rebounders 20 can also be used when training for other sports. For example, rebounder 20 can also be used to rebound projectiles other than soccer balls such as baseballs or lacrosse balls. To better adapt rebounder 20 to other sports, alternative embodiments of rebounder 20 may have different dimensions.

Figure 9:
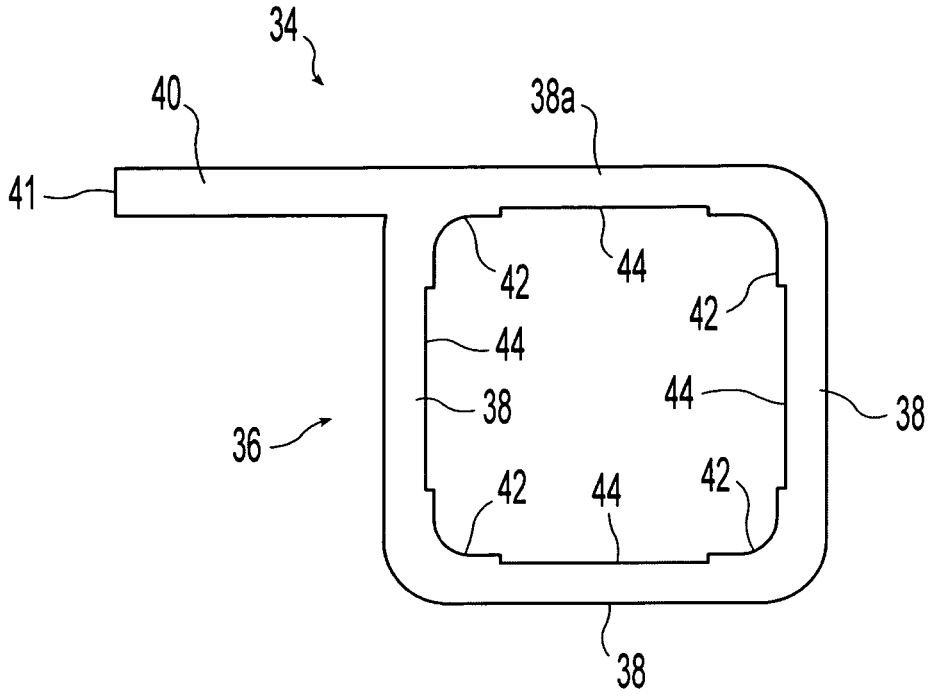
FIG. 9 is an end view of a structural member.

The cross sectional shape 34 of frame members 28 is depicted in FIG. 9. This same cross section 34 is also used to form leg members 30. In other words, each of the frame members 28 and leg members 30 have a cross section defining a common configuration 34. As can be seen in FIG. 9, cross section 34 has a first section 36 taking the form of a generally square and hollow box section portion and a flange 40 that projects outwardly from first section 36. The first section or box portion 36 of cross section 34 is defined by four sidewalls 38 dreinign a hollow, substantially rectangular shape. At the interior of each of the four corners are inwardly projecting lands 42 that extend around the corners between adjacent sidewalls 38. Recessed groove surfaces 44 are located between lands 42 along the mid-section of each of the sidewalls 38. Flange 40 extends outwardly from box section 36 and is substantially co-planar with one of the sidewalls which is designated with reference numeral 38*a* in FIG. 9.

Returning now to the design of rebounder 20, two leg assemblies 26 are pivotally attached to frame 22. Each of the support assemblies 26 includes two leg members 30 and a bracing member 32 secured to each of the two leg members 30. In the illustrated embodiment, bracing members 32 take the form of steel plate and have one end 32*a* attached to flange 40 of one of the leg members 30 and an opposite end 32*b* attached to flange 40 of the other leg member 30. Bracing members 32 may be secured to leg members 30 with nut and bolt assemblies or other suitable securement method.

Figure 11:
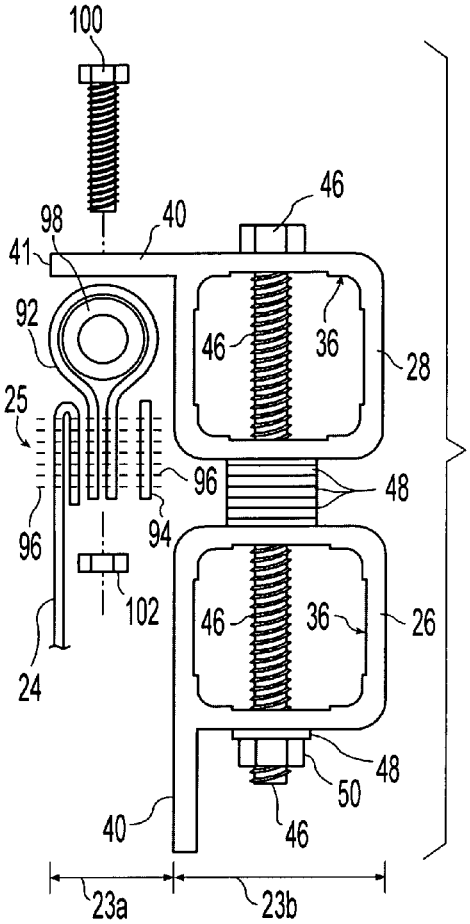
FIG. 11 is a schematic exploded view showing the attachment of the rebounding surface and a pivotal leg assembly.

The pivotal attachment of a leg member 26 to a frame member 28 is best seen in FIGS. 6 and 11. Holes are drilled through opposite side walls 38 of members 26, 28 and a bolt 46 is inserted through the box sections 36 of both the leg member 26 and frame member 28. Bolt 46 also projects through washers 48, or other suitable spacing member, located between the leg member 26 and the frame member 28. A nut 50, which may advantageously take the form of a nylon locking nut, is secured to the distal end of bolt 46. As shown in FIG. 6, a polymeric or rubber foot 52 can be secured with bolt 46. By securing a ground engaging foot 52 on each of the two bolts 46 projecting through one of the frame members 28, rebounder 20 can be positioned with feet 52 engaging the ground surface instead of frame member 28. Feet 52 are adapted to support rebounder 20 while engaging a hard ground surface. For example, the use of a suitable polymeric or rubber material to form feet 52 allows rebounder 20 to be used indoors without damaging the floor surface.

Figure 14:
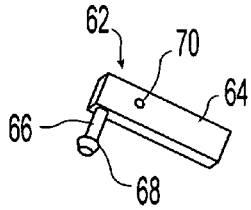
FIG. 14 is a perspective view of a foot assembly usable on finished surfaces.
Figure 15:
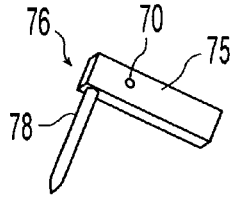
FIG. 15 is a perspective view of a foot assembly usable on a turf surface.
Figure 16:
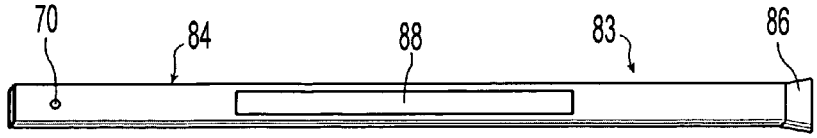
FIG. 16 is a perspective view of an extension foot assembly.

Foot assemblies are removably secured within the distal ends of leg members 30. The illustrated embodiment includes three different foot assemblies for use with rebounder 20. These three foot assemblies are illustrated in FIGS. 14-16. Each of the three illustrated foot members utilize a rigid structural member or shaft 64, 75, 84 having a cross sectional shape 54 depicted in FIG. 10.

Figure 10:
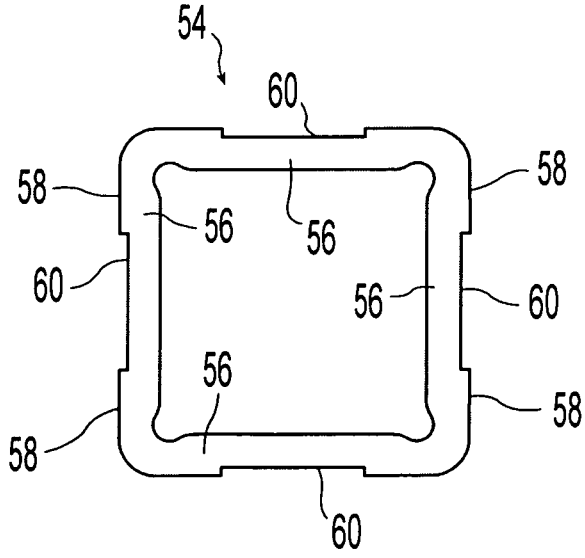
FIG. 10 is an end view of a shaft member.

As can be seen in FIG. 10, cross section 54 has a generally square shape with four side walls 56 and a hollow interior. Outwardly projecting lands 58 are located on the exterior of each of the four corners of cross section 54 and extend between adjacent sidewalls 56 across each corner. Recesses 60 are located along the midsection of each sidewall 56 between lands 58. Cross sectional shapes 34, 54 are configured so that elongate shafts 64, 75, 84 having a cross section 54 can be inserted into box section 36 of legs 30 such that lands 42 are slideably engaged with lands 58. Recesses 44 and 56 limit the surface area along which the cross sections 34, 54 are engageable to thereby reduce frictional resistance to sliding. In other words, shafts 64, 75, 84 are spaced from recessed surfaces 44 when shafts 64, 75, 84 are inserted into legs 30 and slidingly engage corner lands 42.

In the illustrated embodiment, box section 36 and cross section 54 are substantially square such that shafts 64, 75, 84 can be inserted into legs 30 in four separate rotational orientations separated by 90 degrees. In practice, however, it will generally only be useful to employ two of the available orientations for foot assemblies 62 and 76, i.e., the orientation wherein foot members 67 and spikes 78 project radially inwardly pointing toward axis 20*a* (e.g., both pairs of foot assemblies 62, 76 in FIG. 1) or project radially outwardly pointing away from axis 20*a*. FIG. 2 illustrates foot assemblies 62 projecting radially inwardly in solid lines and also includes dashed lines labelled 62*b* that illustrate foot assemblies 62 when they are positioned to project radially outwardly. These two orientations are used when storing and deploying the rebounder and define a 180 degree angle therebetween. The rotational orientation of extension shafts 84 does not impact the functionality of shafts 84.

In the illustrated embodiment, the structural members having a cross section 34 or 54 all take the form of aluminum extrusions. Although various other materials and cross sectional shapes can be used in the manufacture of rebounder 20, the use of extrudable cross sections formed out of aluminum material has several advantages. More specifically, the use of extrudable cross sections helps to minimize the cost of manufacture. Minimizing the number of different cross sectional shapes employed in rebounder 20 also helps to minimize manufacturing costs. By using an aluminum material, the structural members forming rebounder 20 are both strong and lightweight. The lightweight nature of rebounder 20 facilitates the transport and storage of rebounder 20. A handle 21 is attached to frame 22 to allow the rebounder 20 to be conveniently carried.

Turning now to foot assembly 62 illustrated in FIG. 14, foot assembly 62 includes a shaft 64 having a cross sectional shape 54 that is insertable into the box section 36 portion of a leg member 30. Although only one foot assembly 62 is shown in FIG. 14, rebounder 20 includes a pair of foot assemblies 62. A foot member 67 extends at a right angle to shaft 64 and includes a short post 66 and a foot 68. Post 66 extends outwardly from a sidewall 56 of shaft 64 and non-metallic foot 68, e.g., a rubber or polymeric foot, is secured at the distal end of post 66 for engaging a ground surface. Non-metallic foot 68 is well adapted for engaging a hard ground surface such as a concrete surface or an interior floor and allows rebounder 20 to be used on interior floors with only feet 52 and 68 engaging the floor surface to thereby reduce the possibility of damaging the floor surface. Feet 68 can also be used to engage the ground surface when using rebounder 20 outside. For example, feet 68 are well adapted for use on such hard ground surfaces as concrete but can also be used with other ground surfaces such as turf.

Figure 13:
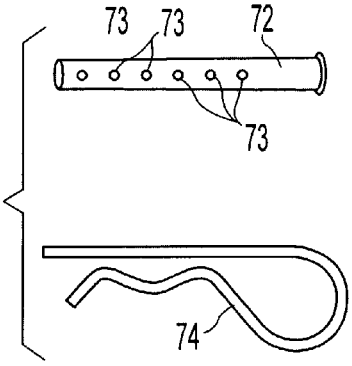
FIG. 13 is a view of a clevis and cotter pin assembly.

Openings 70 are drilled or otherwise formed in opposing sides of shafts 64 and in leg members 30. Shafts 64 are secured in leg members 30 by inserting a clevis pin 72 (FIG. 13) through the openings 70 in both the leg member 30 and mounting member 64. A cotter pin 74 (FIG. 13) is then inserted through one of the openings 73 in clevis pin 72 to prevent the inadvertent withdraw of the clevis pin 72.

Figure 12:
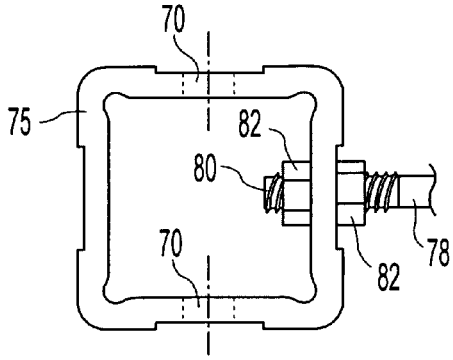
FIG. 12 is a schematic end view of a shaft.

Turning to FIG. 15, one of a pair of foot assemblies 76 having a lawn spike 78 is illustrated. Metal lawn spike 78 has a spiked end and an opposite threaded end 80 that is attached to a shaft 75 having a cross section 54. Spike 78 is attached with nuts 82 as depicted in FIG. 12. Posts 66 can be attached to shafts 64 in a similar fashion. Spike 78 can be employed when using rebounder 20 on turf or similar piercable ground surface by driving spike 78 partially into the ground and thereby securely holding rebounder 20 in a desired location.

Turning to FIG. 16, one of a pair of foot assemblies 83 having an extension shaft 84 is shown. Extension shaft 84 is an elongate extrusion having a cross section 54. Openings 70 are located on extension shafts 84 for securing extension shafts 84 to legs 30. A cap 86 made of out of a rubber, polymeric or other suitable material is positioned on the end of extension shaft 84 opposite openings 70 for engagement with the ground. Hook and loop fasteners, e.g., Velcro® material, are used to secure extension shafts 84 to rebounder 20 when shafts 84 are not in use. In the illustrated embodiment, a strip of either hook or loop material 88 is secured to an exterior surface of the extension shafts 84 and a strip of the other hook or loop material 90 is secured to bracing members 32.

Figure 7:
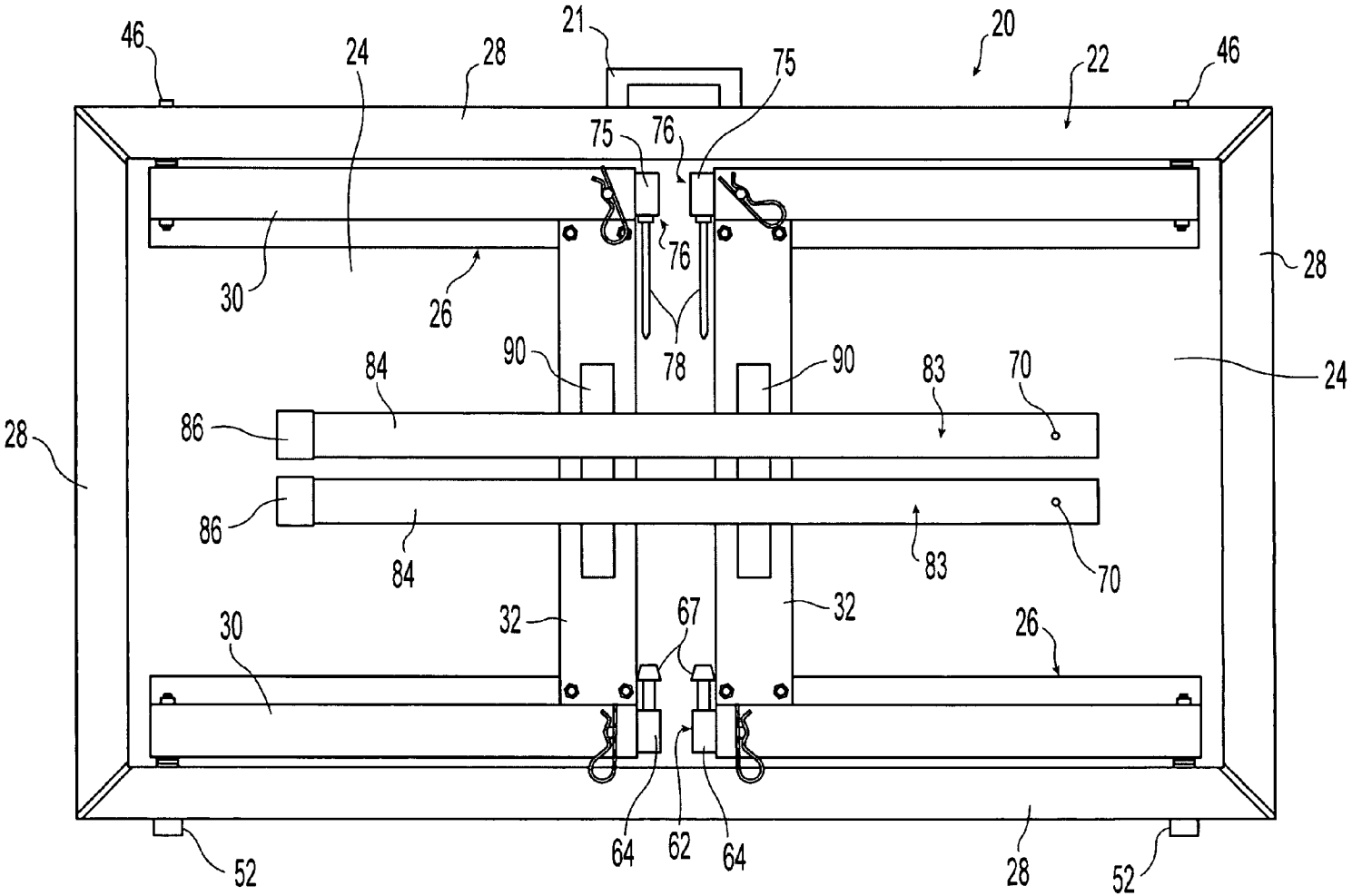
FIG. 7 is a rear view of the rebounder in a collapsed configuration.

When not in use, each of the foot assemblies 62, 76 can be storably inserted into a respective one of the leg members 30 with posts 66 and spikes 78 pointing inward to allow leg assemblies 26 to be pivoted to a collapsed configuration wherein leg members 30 are positioned proximate to structural frame 22. More specifically, leg assemblies 26 are positioned adjacent and parallel to the longer frame members 28 as shown in FIG. 7. Extension legs 84 are then secured to bracing members 32 by engaging hook and loop fasteners 88, 90. The engagement of extension legs 84 with an exterior surface of leg assemblies 26 not only secures extension legs 84 to rebounder 20 but also secures leg assemblies 26 in their collapsed configuration illustrated in FIG. 7. In the exemplary embodiment, the exterior surface of leg assemblies 26 that is engaged by extension legs 84 is defined by fasteners 90 located on bracing members 32.

When it is desired to use rebounder 20, extension legs 84 are detached from bracing members 32 and leg assemblies 26 are positioned appropriately. If the rebounder 20 is going to be positioned with its longer sides in a substantially horizontal orientation, both leg assemblies 26 are pivoted outwardly. FIGS. 1 and 2 illustrate rebounder 20 in a horizontal configuration with both leg assemblies 30 pivoted to project outwardly from structural frame 22. If rebounder 20 is positioned on a piercable ground surface, the pair of turf spike feet assemblies 76 are positioned in the two lowermost leg members 30 with spikes 78 facing the ground surface. If spiked foot assemblies 76 were positioned in the lowermost legs 30 during transport, positioning spiked foot assemblies 76 will entail removing assemblies 76 from leg members 30, rotating the foot assemblies 76 by 180 degrees and then reattaching foot assemblies 76 to leg members 30 so that spikes 78 can be pressed into the ground. If foot assemblies 62 were located in the lowermost legs 30, the process would further involve interchanging the location of foot assemblies 62 with foot assemblies 76. If rebounder 20 is to be used on a surface unsuitable for spikes 78, the same process would be employed to secure foot assemblies 62 in the lower most legs 30 with foot members 67 projecting toward the ground surface.

Figure 8:
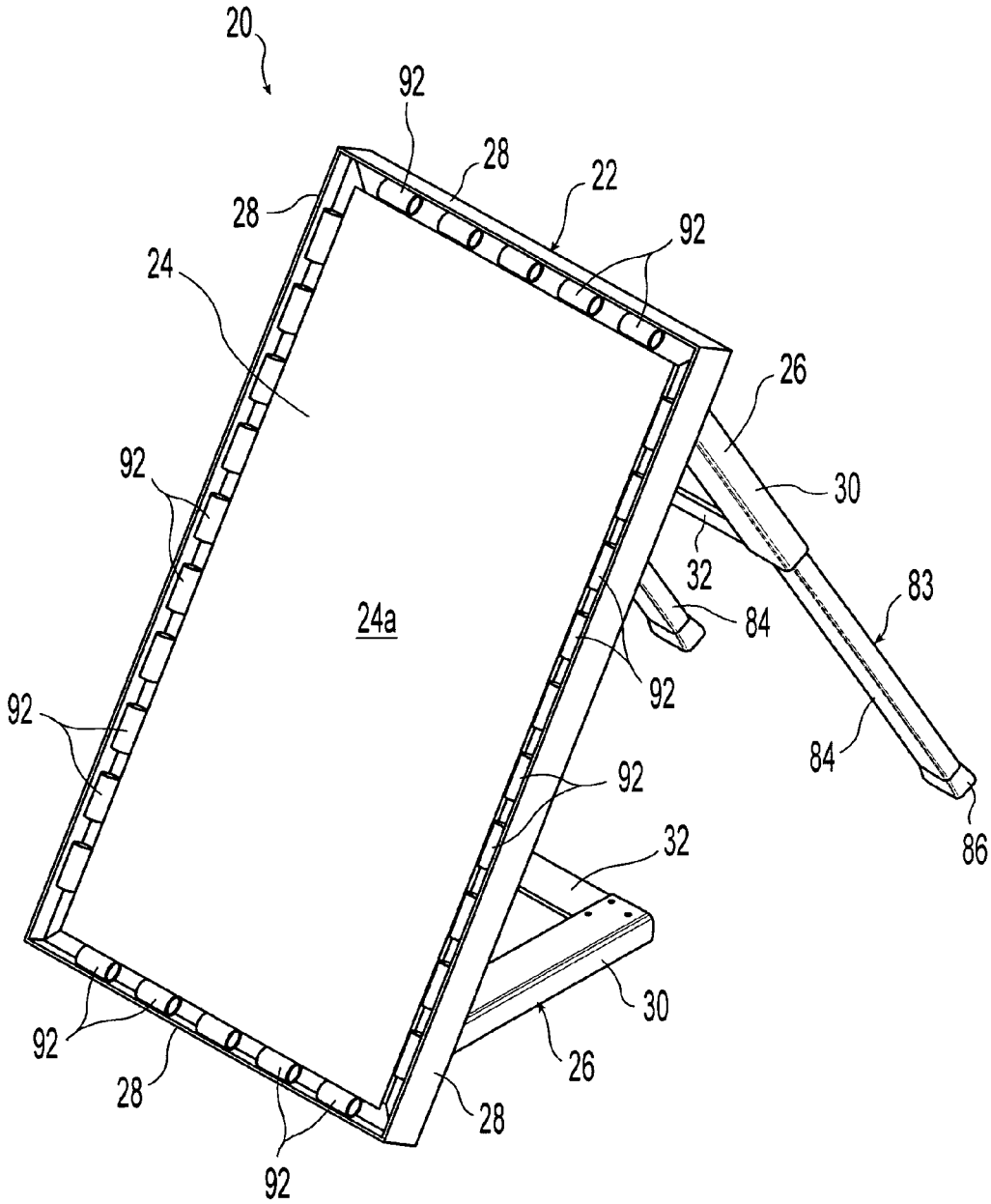
FIG. 8 is a front perspective partial view of the rebounder in a vertical deployed configuration (mounting members for securing the rebounding surface are not shown).

If it is desired, rebounder 20 can also be used in a vertical configuration as depicted in FIG. 8 with its longer dimension in a substantially vertical orientation. In the vertical configuration depicted in FIG. 8, one of the leg assemblies 26 is positioned in a non-weight-bearing position while the other leg assembly having extension legs 84 attached thereto projects outwardy from frame 22 toward the ground surface so that extension legs 84 can bearingly engage the ground. The leg assembly in a non-weight bearing position may be positioned adjacent rebounding surface 24 or, more commonly, will lay flat on the ground surface as shown in FIG. 8. As can be seen in FIG. 8, when rebounder 20 is in a more vertical orientation, it will be well suited to rebound baseballs. In the illustrated embodiment, extension shafts 84 are longer than shafts 64 and shafts 75.

It should be noted that FIG. 8 is only a partial illustration and omits some of the parts used to secure rebounding surface 24 to frame 22, e.g., elongate mounting members 98. The securement of rebounding member 24 to frame 22 is best understood with reference to FIGS. 5 and 8 and the exploded schematic view presented in FIG. 11. Rebounding member 24 takes the form of a flexible woven polypropylene trampoline fabric in the illustrated embodiment. Trampoline fabric is not a highly elastic material and the spring force for returning balls impacting rebounding surface 24 is provided by tension members 92. The illustrated bounceback assembly 25 is a springless assembly and utilizes woven elastic material loops 92 instead of coil springs. The use of a woven elastic material 92 instead of coil springs reduces the gap between the outer edge of rebounding surface 24 and frame 22 and thereby increases the effective rebounding surface 24*a* of rebounder 20 defined by rebounding member 24.

In the illustrated embodiment, the woven elastic material 92 has a width of approximately 2 inches plus or minus 3/32 inch; Warp: 352 ends 2/150 textured polyester; Binder: 41 ends 2/150 textured polyester; Elastomer: 42 ends 22 gauge natural rubber; Picks per inch: 50 plus or minus 3; Stretch: 70% plus or minus 10%. As can be seen in FIG. 8, a series of woven elastic material loops 92 are attached along each of the outer edges 93 of trampoline fabric 24. FIG. 11 illustrates the manner in which the woven elastic material 92 is attached to form loops. More specifically, trampoline fabric 24 is folded over to define its outer edges 93 and the two opposing ends of the woven elastic material 92 are overlapped with the folded edge. A suitable backing material 94 is positioned opposite the folded edge of the trampoline material 24 and this layered structure is secured together with stitching 96. It is also noted that in the alternative embodiment illustrated in FIG. 17, backing material is located on both sides of unfolded the trampoline material. Various other suitable attachment methods may also be employed to secure flexible fabric 24 with elastic loops 92.

An elongate mounting member 98 is inserted through the woven elastic material loops 92 along each of the four sides of the trampoline material 24. In rebounder 20, four elongate mounting members 98 are employed, one member 98 extending along each of the four frame members 28, with each of the four members 98 taking the form of PVC piping of the same diameter. Other materials, such as a suitably sized metal bar could be used instead of PVC piping. Holes are drilled through the PVC pipes 98 at locations between adjacent loops 92. Corresponding holes are drilled through flange 40 of frame members 28. Bolts 100 are inserted through the holes in the flanges 40 of frame members 28 and PVC pipes 98 and secured with nuts 102 (e.g., locking nylon nuts) to thereby taughtly mount trampoline material 24 within frame 22.

Significant tension is imparted to woven elastic material loops 92 and trampoline fabric 24 when installing trampoline fabric 24. To facilitate the installation of trampoline fabric 24, it is advantageous to start the process by using bolts having a length greater than bolts 100 at every other bolt location. After these longer bolts have been partially tightened, the PVC pipes 98 will be drawn close enough to flanges 40 for bolts 100 to pass through both flange 40 and PVC pipes 98. Bolts 100 can then be installed at the open bolt holes between the longer bolts and partially tightened. The longer bolts can then be removed and replaced with bolts 100 and the installation of bounceback assembly 25 completed.

As can be understood with reference to FIGS. 8 and 11, the construction of rebounder 20 provides several advantages. The configuration of frame members 28 provides a box section 36 of extruded aluminum material along the outer perimeter of rebounder thereby providing strength to resist bowing of rectangular frame 22 which, in turn, allows for the use of strong tensile force to stretch trampoline fabric 24. While rebounder 20 may take various shapes including circular and rectilinear shapes, the use of a box section 36 along the outer perimeter of frame 22 is particularly advantageous in rebounders 20 having non-circular frames wherein the frame members 28 will be subjected to relatively greater bending forces.

The use of a flange 40 extending from box section 36 at the outermost edge of frame 22 coupled with the use of woven elastic material 92 instead of coil springs to provide the tensile forces on trampoline fabric 24 minimizes the gap between the outermost perimeter of frame 22 and the rebounding surface 24*a*. This allows rebounder 20 to be placed on the ground such that the midpoint of a soccer ball rolling along the ground will strike trampoline fabric 24 at a point radially inwardly of woven elastic material 92 where trampoline fabric 24 provides an effective rebounding surface and be propelled back away from trampoline fabric 24. In the illustrated rebounder 20, this "low profile" aspect of the rebounding surface 24 is provided along all four edges of the rebounder, however, alternative embodiments of the rebounder could employ "low profile" edges along only one or a limited number of selected edges of the rebounder. The use of woven elastic bands not only facilitates the enhancement of the rebounding surface area of rebounder 20 but also provides a reliable and long lived product that can be relatively easily and cost efficiently manufactured. As mentioned above, the use of aluminum extrusions in the construction of rebounder 20 allows the robust frame 22 to remain relatively light and portable.

The low profile nature of rebounder 20 can be readily understood with reference to FIGS. 1 and 11. As can be seen in FIG. 11, flanges 40 project axially from box sections 36 and terminate at distal ends 41. A first axial length 23*a* of central opening 23 is circumscribed by flanges 40 and extends axially from distal ends 41 to box sections 36 of frame members 28. A second axial length 23*b* of central opening is circumscribed and has axial limits defined by box sections 36 of frame members 28. As can be readily appreciated from FIGS. 1 and 11, a substantial majority of box sections 36 is disposed radially inwardly of flanges 40. As a result, the first axial length 23*a* of central opening defines a larger opening than the second axial length 23*b*. Moreover, because bounceback assembly 25 is disposed within first axial length 23*a*, rebounding surface 24*a* may be larger than if bounceback assembly 25 was located within second axial length 23*b*. In the illustrated embodiment, rebounding surface 24*a* has a surface area greater than the area of the opening defined by second axial length 23*b* (measured in a plane perpendicular to axis 20*a*). In rebounder 20, mounting members 98 are secured to flanges 40, however, in alternative embodiments, it would be possible to secure one or more or all of the mounting members to box sections 36 of frame members 28 instead of flanges 40.

Figure 17:
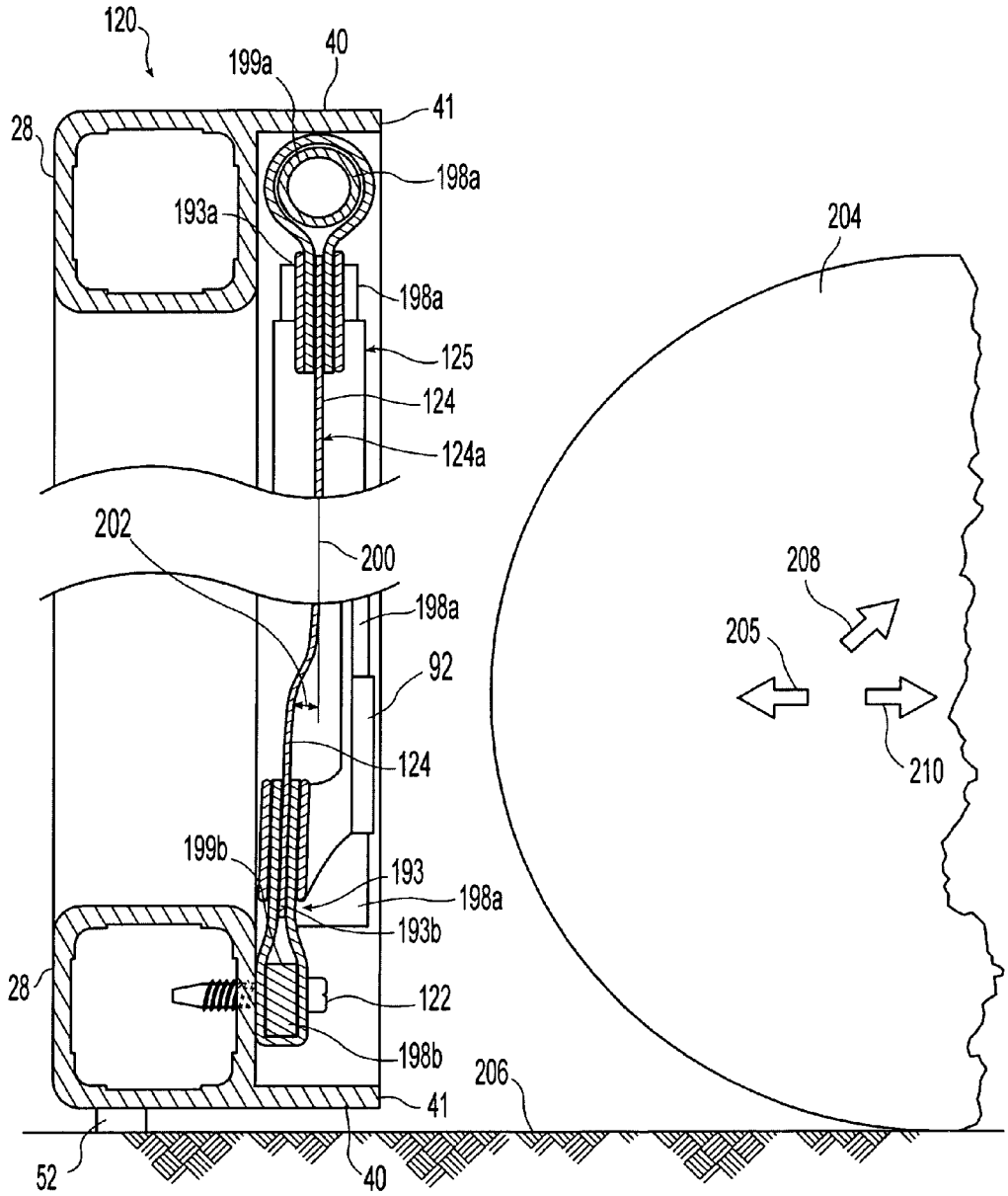
FIG. 17 is a schematic partial cross sectional view of a second embodiment.

An alternative rebounder 120 is depicted in FIG. 17. Rebounder 120 is similar to rebounder 20 except for the elongate mounting members used to secure elastic loops, the attachment of the elongate mounting members and the resulting changes in the shape of tensioned rebounding member. The flexible sheet of trampoline fabric 124 of bounceback assembly 125 of rebounder 120 defines a rebounding surface 124*a* having an outer edge 193 and is mounted within first axial length 23*a* of central opening 23. A plurality of elastic loops 192 are attached to rebounding member 124 proximate outer edge 193. Three elongate mounting members 198*a* are taking the form of PVC piping defining a first cross sectional shape 199*a* are inserted through loops 192 along three of the four sides of frame 22. Mounting members 198*a* are similar to mounting members 98 and are secured to flanges 40 in the same manner described above for mounting members 98.

A second type of mounting member 198*b* is used along the fourth side of rebounder 120. Advantageously, mounting member 198*b* is attached to frame member 28 having feet 52 secured thereto. Mounting member 198*b* takes the form of a metal bar and has a thinner cross section 199*b* than the cross sections 199*a* of mounting members 198*a*. Another difference between mounting member 198*b* and mounting members 198*a* is that mounting member 198*b* is attached to box section 36 with self-tapping screws 122 or other suitable securement method. In other words, each of the three mounting members 198*a* are attached at a common axial position (on flange 40) while mounting member 198*b* is attached at an axial position (on box section 36) that is axially spaced from the axial position at which mounting members 198*a* are attached.

Because similar mounting members 198*a* are attached at common axial locations along three of the sides of rebounder 120, a first portion 193*a* of outer edge 193 of trampoline fabric 124 that is positioned alongside mounting members 198*a* lies within a common plane 120 as schematically depicted in FIG. 17. As a result of both using a thinner cross section 199*b* for mounting member 198*b* and by attaching it at different axial location, a second portion 193*b* of outer edge 193 located along mounting member 198*b* is axially displaced from the common plane 200 defined by first edge portion 193*a*. More specifically, three mounting members 198*a* are attached to three sides of frame 22 and rebounding surface 124*a* is positioned closest to second axial length 23*b* of opening 23 proximate the fourth side of frame 22 to which mounting member 198*b* is attached. Although this is accomplished in the illustrated rebounder 120 both by altering the cross section of mounting member 198*b* and altering the axial mounting location of mounting member 198*b* alternative embodiments could accomplish a similar result by using only one of these methods, i.e., altering only the cross section or mounting location.

The angle 202 that the portion of rebounding surface 124*a* forms along second edge portion 193*b* with the remainder of rebounding surface 124*a* that lies in common plane 200 can be beneficial when rebounding surface 124*a* is struck by a soccer ball 204 rolling on the ground surface 206. (A small portion of the rebounding surface at the corners along second edge portion 193*b* will assume a more complex curvature.) When all of the rebounding surface lies in a common plane such as with rebounder 20, a soccer ball 204 rolling on the ground surface will oftentimes be rebounded in an airborne fashion by the rebounding surface. This can be the result of rebounder 20 be positioned in a slightly rearward leaning manner. By using a mounting member 198*b* to form a slight angle 202 in rebounding surface 124*a* adjacent one edge of rebounder 120 and positioning the angled edge along the ground surface, the angled edge of rebounding surface 124*a* will more likely be positioned in a vertical or forward leaning orientation and rebound a rolling soccer ball in a rolling manner rather than rebounding it an airborne manner. In FIG. 17, directional arrow 205 indicates the motion of a rolling soccer that is about to strike rebounder 120, directional arrow 108 indicates the direction of an airborne rebound and directional arrow 110 indicates the direction of a rolling rebound. The more controlled rolling rebound is oftentimes considered to be the more desirable manner of rebounding a rolling soccer ball.

While this invention has been described as having an exemplary design, the present invention may be further modified within the spirit and scope of this disclosure. This application is therefore intended to cover any variations, uses, or adaptations of the invention using its general principles.

What is claimed is:

1. A springless rebounding apparatus for rebounding a projectile, said rebounding apparatus comprising:

a plurality of elongate frame members secured together to form a structural frame defining a central opening, each of said frame members having a cross section that includes a first section and a flange projecting outwardly from said first section, said flange defining a distal edge, said frame members being secured together wherein said flanges project axially from said first sections wherein a first axial length of said central opening circumscribed by said flanges and axially disposed between said distal edges of said flanges and said first sections forms a larger opening than a second axial length of said central opening circumscribed by said first sections of said frame members;

a springless bounceback assembly supported by said structural frame within said first axial length of said central opening and adapted to rebound the projectile, said bounceback assembly including a flexible sheet of material defining a rebounding surface and having an outer edge, a plurality of elastic loops secured to said flexible sheet proximate said outer edge, and a plurality of elongate mounting members, each of said mounting members being inserted through at least one of said elastic loops and being secured to one of said frame members; and wherein said structural frame defines a four-sided rectilinear structure and wherein said plurality of elongate mounting members includes three mounting members secured to said flanges on three sides of said structural frame and a fourth mounting member secured to a first section on a fourth side of said structural frame and wherein said rebounding surface is positioned closest to said second axial length proximate said fourth side of said structural frame.

2. The rebounding apparatus of claim 1 wherein a substantial majority of said first sections of each of said frame member cross sections is disposed radially inwardly of said flanges.

3. The rebounding apparatus of claim 2 wherein each of said frame member cross sections has a common configuration and wherein said first sections each include four sidewalls defining a hollow, substantially rectangular shape and said flange projects substantially coplanar with one of said four sidewalls.

4. The rebounding apparatus of claim 3 further comprising at least one elongate leg secured to said structural frame and extendable outwardly from said structural frame, said at least one leg having a cross section that defines said common configuration.

5. The rebounding apparatus of claim of claim 4 further comprising at least one foot assembly having an elongate shaft insertable into said at least one leg.

6. The rebounding apparatus of claim 3 further comprising:

a pair of leg assemblies, each of said leg assemblies including a pair of elongate legs defining a hollow cross section, each of said leg assemblies being pivotally secured to said structural frame wherein said leg assemblies are pivotal between a collapsed configuration wherein both of said leg assemblies are positioned proximate said structural frame, a horizontal deployment configuration wherein both of said leg assemblies project outwardly from said structural frame, and a vertical deployment configuration wherein one of said leg assemblies is positioned in a non-weight bearing position and the other of said leg assemblies projects outwardly from said structural frame toward the ground surface;

a pair of first foot assemblies, each of said first foot assemblies including a first shaft insertable into a selected one of said legs and including a first foot member extending at an angle from said first shaft, said first foot members each including a lawn spike adapted for use with a piercable ground surface;

a pair of second foot assemblies, each of said second foot assemblies including a second shaft insertable into a selected one of said legs and including a second foot member extending at an angle from said second shaft, said second foot members each including a ground engaging member adapted for use with a hard ground surface;

a pair of third foot assemblies, each of said third foot assemblies including a third extension shaft insertable into a selected one of said legs, said third extension shafts being longer than said first and second shafts; and wherein when said leg assemblies are in said collapsed configuration, said pair of first foot assemblies and said pair of second foot assemblies are storably insertable in said legs of said first and second leg assemblies and said pair of third foot assemblies is securable to an exterior surface of said first and second leg assemblies, securement of said pair of third foot assemblies to said first and second leg assemblies securing said first and second leg assemblies in said collapsed configuration.

7. The rebounding apparatus of claim 1 wherein said fourth mounting member has a different cross section than said three mounting members secured to said flanges.

8. The rebounding apparatus of claim 1 wherein said plurality of elongate mounting members includes three mounting members having a first cross section and secured to three sides of said structural frame and a fourth mounting member having a second cross section differing from said first cross section secured to the fourth side of said structural frame.

9. A rebounding apparatus for rebounding a projectile, said rebounding apparatus comprising:

a plurality of elongate frame members secured together to form a structural frame defining a central opening;

a bounceback assembly supported by said structural frame within said central opening and adapted to rebound the projectile, said bounceback assembly including a flexible sheet of material defining a rebounding surface and having an outer edge and a plurality of tensioning members operably disposed between said flexible sheet and said structural frame;

a pair of leg assemblies, each of said leg assemblies including a pair of elongate legs defining a hollow cross section, each of said leg assemblies being pivotally secured to said structural frame wherein said leg assemblies are pivotal between a collapsed configuration wherein both of said leg assemblies are positioned proximate said structural frame, a horizontal deployment configuration wherein both of said leg assemblies project outwardly from said structural frame, and a vertical deployment configuration wherein one of said leg assemblies is positioned in a non-weight bearing position and the other of said leg assemblies projects outwardly from said structural frame toward the ground surface;

a pair of first foot assemblies, each of said first foot assemblies including a first shaft insertable into a selected one of said legs and including a first foot member extending at an angle from said first shaft, said first foot members each including a lawn spike adapted for use with a piercable ground surface;

a pair of second foot assemblies, each of said second foot assemblies including a second shaft insertable into a selected one of said legs and including a second foot member extending at an angle from said second shaft, said second foot members each including a ground engaging member adapted for use with a hard ground surface;

a pair of third foot assemblies, each of said third foot assemblies including an elongate extension shaft insertable into a selected one of said legs said third extension shafts being longer than said first and second shafts; and wherein when said leg assemblies are in said collapsed configuration, said pair of first foot assemblies and said pair of second foot assemblies are storably insertable in said legs of said first and second leg assemblies and said pair of third foot assemblies is securable to an exterior surface of said first and second leg assemblies, securement of said pair of third foot assemblies to said first and second leg assemblies securing said first and second leg assemblies in said collapsed configuration.

10. The rebounding apparatus of claim 9 wherein each of said plurality of frame members and each of said legs have a cross section defining a common configuration.

11. The rebounding apparatus of claim 10 wherein said common configuration includes four sidewalls defining a hollow, substantially rectangular shape which includes four interior corners, said interior corners each defining an inwardly projecting land and wherein each sidewall defines a recessed groove surface separating said corner lands, said first, second and third shafts being slidingly engageable with said corner lands and spaced from said groove surface when inserted into said legs.

12. The rebounding apparatus of claim 11 wherein said common configuration further includes a flange projecting outwardly from said substantially rectangular shape wherein said flange is substantially coplanar with one of said four sidewalls, each of said flanges defining a distal edge, said flanges projecting axially from said rectangular shape wherein a first axial length of said central opening circumscribed by said flanges and axially disposed between said distal edges of said flanges and said rectangular shapes forms a larger opening than a second axial length of said central opening circumscribed by said rectangular shapes of said frame members and wherein said bounceback assembly is disposed within said first axial length of said central opening.

13. The rebounding apparatus of claim 12 wherein each leg assembly includes a brace member having one end attached to said flange of one leg of said pair of legs and an opposite end attached to said flange of the other of said pair of legs.

14. The rebounding apparatus of claim 9 wherein each of said first and second shafts can be inserted in said legs in at least two orientations wherein said two orientations define a 180 degree angle therebetween.

15. A rebounding apparatus for rebounding a projectile, said rebounding apparatus comprising:

a plurality of elongate frame members secured together to form a structural frame defining a central opening; each of said frame members having a cross section that includes a first section and a flange projecting outwardly from said first section, said flange defining a distal edge, said frame members being secured together wherein said flanges project axially from said first sections wherein a first axial length of said central opening circumscribed by said flanges and axially disposed between said distal edges of said flanges and said first sections forms a larger opening than a second axial length of said central opening circumscribed by said first sections of said frame members;

a springless bounceback assembly supported by said structural frame within said central opening and adapted to rebound the projectile, said bounceback assembly including a flexible sheet of material defining a rebounding surface and having an outer edge, a plurality of elastic loops secured to said flexible sheet proximate said outer edge, a first plurality of elongate mounting members and a second elongate mounting member, each of said mounting members being inserted through at least one of said elastic loops and being secured to one of said frame members;

wherein a first portion of said outer edge of said flexible sheet extending adjacent each of said first plurality of elongate mounting members is positioned in a common plane and a second portion of said outer edge of said flexible sheet extending adjacent said second elongate mounting member is axially displaced relative to said common plane; and wherein said structural frame defines a four-sided rectilinear structure and wherein said first plurality of elongate mounting members includes three mounting members having a first cross section and secured to three sides of said structural frame and the second elongate mounting member having a second cross section differing from said first cross section secured to a fourth side of said structural frame and wherein said rebounding surface is positioned closest to said second axial length proximate said fourth side of said structural frame.

16. The rebounding apparatus of claim 15 wherein said first plurality of elongate mounting members are each attached to one of said frame members at a common axial position and said second elongate mounting member is attached to one of said frame members at a second axial position axially spaced from said common axial position.

* * * * *